US005549539A

United States Patent [19]

Rautenberg

[11] Patent Number: 5,549,539

[45] Date of Patent: Aug. 27, 1996

[54] DEVICE FOR GROOVING CONTINUOUSLY-FED FLAT WORKPLACE

[75] Inventor: Horst Rautenberg, Lienen, Germany

[73] Assignee: Windmoeller & Hoelscher, Lengerich/Westf., Germany

[21] Appl. No.: 573,587

[22] Filed: Dec. 15, 1995

Related U.S. Application Data

[63] Continuation of Ser. No. 220,000, Mar. 30, 1994, abandoned.

[30] Foreign Application Priority Data

Mar. 30, 1993 [DE] Germany ..... 43 10 289.1

[51] Int. Cl.[6] ..... B31B 1/36

[52] U.S. Cl. ..... 493/402; 493/403; 493/241; 493/355

[58] Field of Search ..... 493/402, 403, 493/161, 241, 355

[56] References Cited

U.S. PATENT DOCUMENTS

| | | | |
|---|---|---|---|
| 1,414,549 | 5/1922 | Cleary | 493/402 |
| 1,828,234 | 10/1931 | Swift, Jr. | 493/402 |
| 4,417,883 | 11/1983 | Granger et al. | 493/403 |
| 4,936,818 | 6/1990 | Holohan, Jr. | 493/403 |
| 5,154,410 | 10/1992 | Baader et al. | 271/188 |

FOREIGN PATENT DOCUMENTS

| | | |
|---|---|---|
| 1364183 | 5/1964 | France . |
| 1299514 | 4/1970 | Germany . |
| 3811221 | 10/1989 | Germany . |
| 0976276 | 7/1963 | United Kingdom . |

*Primary Examiner*—Bruce M. Kisliuk
*Assistant Examiner*—Eileen P. Morgan
*Attorney, Agent, or Firm*—Jacobson, Price, Holman & Stern, PLLC

[57] ABSTRACT

A device for grooving continuously-fed flat workpieces to form fold lines, including a slotted disc with a circumferential groove into which groove the circular edge of a grooving disc penetrates, which together with the slotted disc constitutes the grooving tool. A clamp rollers which runs off of a cylindrical section of the slotted disc prevents the free outer areas of the workpiece from being pulled into the operating grooving tool. In order to decrease structural expenditure, the clamp roller includes a cylindrical disc adjoining the grooving disc which rotates at the same rate of revolutions as the grooving disc.

1 Claim, 1 Drawing Sheet

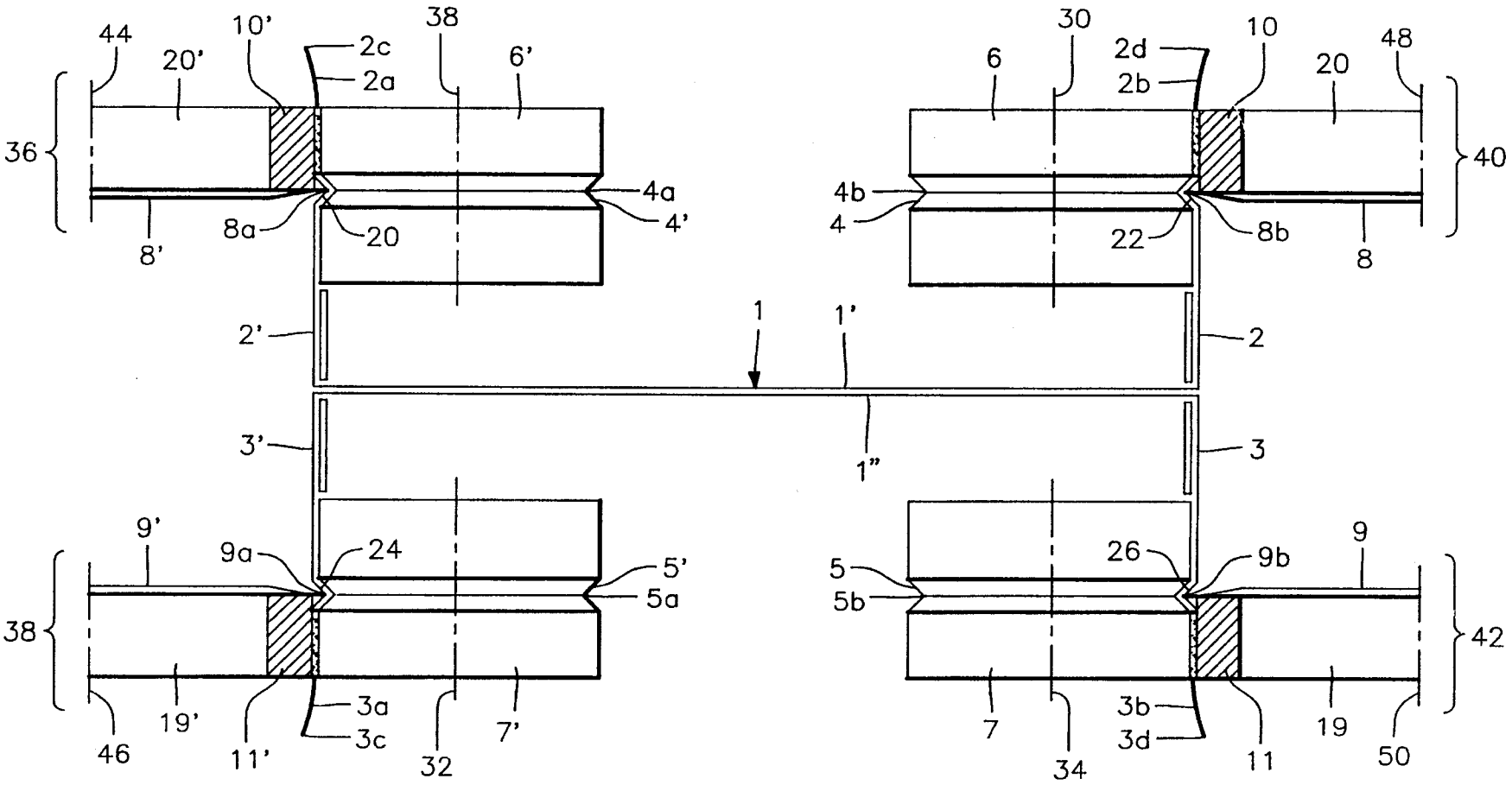
40
42
48
50
8
9
20
19
10
11
8b
9b
2
3
2d
2b
22
26
3b
3d
30
34
6
7
4b
4
1'
1"
5
5b
1
4a
4'
5'
5a
6'
7'
38
32
2c
2a
20
24
3a
3c
10'
8a
2'
3'
9a
11'
20'
19'
8'
9'
44
46
36
38

DEVICE FOR GROOVING CONTINUOUSLY-FED FLAT WORKPLACE

This application is a file wrapper continuation of application Ser. No. 08/220,000, filed Mar. 30, 1994, now abandoned.

FIELD OF THE INVENTION

The invention deals with a device for grooving continuously-fed flat workpieces to form fold lines, mainly for forming the fold lines of the inward-folding side panels of raised crossed-bottoms in sack manufacturing, consisting of a slotted disc having a circumferential groove into which groove the circular edge of a grooving disc penetrates, which together constitute the grooving tool, and of a clamp roller running off of contact with a cylindrical section of the slotted disc which prevents the free outer area of the workpiece from being pulled into the operating grooving tool.

BACKGROUND OF THE INVENTION

It is especially common with paper bag manufacturing to pre-groove the fold lines in order to obtain clean folds. The grooving device described in FIG. 4 of French PS 13 64 183 for forming the fold lines which divide off the inward-folding side panels of raised crossed-bottoms of crossed-bottom sacks provides an example of how the fold lines formed through grooving slant towards the outside, because the sack material is pulled into the groove by the grooving disc.

The phenomenon of the sack material being pulled into the center of the sack during the formation of the fold lines which divide off the side flaps of raised cross-bottoms is described in German PS 12 99 514. It was suggested in this publication to set up a powered press-roller on the free running sides of the workpiece next to the grooving disc, which would run off of cylindrical sections of discs equipped with grooving slots and would exert outwardly-directed tension on the material ends. However, the device described in German PS 12 99 514 requires increased structural expenditure, in that the press-roller running off of a cylindrical section of the grooving disc is mounted on an angled lever which swivels in the machine housing and is supplementally equipped with its own drive.

SUMMARY OF THE INVENTION

Thus, the purpose of the invention is to create a device which, with limited structural expenditure, allows the grooving of workpieces with groove lines extending parallel to their side edges.

This purpose of the invention was achieved by fashioning the clamp roller out of a cylindrical disc adjoining the grooving disc which rotates at the same rate of revolutions as the grooving disc. The device resulting from this invention leads to a considerably simplified mode of construction, because the grooving disc itself supports the press-roller or clamp roller, so that no separate clamp roller with its own mounting and its own drive is needed.

For this purpose the grooving disc is combined with the cylindrical disc which constitutes the clamp roller.

In an expanded form of the invention, the cylindrical disc is fitted with a ring-like or gripping roll made out of elastomer material.

The diameter of the ring-like casing corresponds to the diameter of the grooving disc for the purpose of ensuring the required traction.

The edge of the grooving disc is to dip into the groove of the slotted disc only enough to ensure grooving of the material without crushing the material.

BRIEF DESCRIPTION OF THE DRAWING

An example of the operation of the invention is pried below with an illustration, in which a single drawing, FIG. 1, presents a frontal view, schematically depicting the grooving tools which provide the raised crossed-bottom of a sack with the fold lines which divide off the inward-folding side panels.

DETAILED DESCRIPTION OF THE DRAWING

Material piece 1, having two plies 1' and 1" is continuously fed through conveying equipment (not depicted), is supplied with raised crossed-bottoms on both of its ends, from whose lateral parts 2, 3, and 2', 3', inward-folding side panels 2*a*, 2*b*, 3*a*, 3*b*, are divided off through groove lines 20, 22, 24, 26, which in a later operation are pushed in towards the inside around the groove lines 20, 22, 24, 26 to lay out the bottoms in such a way that their outer ends overlap. In order to produce clean folds for the bottom it is necessary to divide off the inward-folding side panels 2*a*, 2*b*, 3*a*, 3*b*, by groove lines 20, 22, 24, 26, which are parallel to the outer edges 2*c*, 2*d*, 3*c*, 3*d*, of the raised material.

Opposing slotted discs 6, 7 and 6', 7', having grooves 4, 5, and 4', 5' terminating in vertices 4*a*, 4*b*, 5*a*, 5*b*, are rotatably mounted about their central axes 28,30,32,34 with axes 28 and 32 being aligned and axes 30 and 34 being aligned, for forming the fold lines 20, 22, 24, 26 in the end areas, including the side panels 2*a*, 2*b*, 3*a*, 3*b*, of the raised lateral parts 2, 3 and 2', 3', which operate in conjunction with the grooving discs 8, 9 terminating in circular edge 8*a*, 8*b*, 9*a*, 9*b* and 8', 9' which penetrate into the grooves 4,5 toward the vertices 4*a*, 4*b*, 5*a*, 5*b* and 4', 5'. It can be discerned from the FIGURE that the grooving discs 8, 9 and 8', 9' do not penetrate into the base of the grooves 4, 5 but only approach the vertices 4*a*, 4*b*, 5*a*, 5*b*and 4', 5'. As a result, the areas to be grooved from the lateral parts 2, 3 and 2', 3' are indeed grooved, but are not crushed against the bottom of the grooves 4, 5 and 4', 5' at the vertices 4*a*, 4*b*, 5*a*, 5*b*.

So that the free running ends of the areas 2, 3 and 2', 3' including the side panels 2*a*, 2*b*, 2*c*, 2*d* to be grooved are not pulled in during the grooving process, schematically shown cylindrical discs 19, 20, 19', 20' have radially outermost rings 10, 11 and 10', 11' made out of elastic material are attached to the grooving laterally outward side of the discs 8, 9 and 8', 9', to form clamp rollers 36, 38, 40, 42, rotatable about central axes 44, 46, 48, 50 whose outside diameter ring 10, 11, 10', 11' is exactly the same as the outside diameter of the grooving discs 8, 9 and 8', 9'. When the grooving discs penetrate into the grooves, the rings 10, 11 and 11' are compressed, as is shown in the FIGURE, against the free running end areas of side panels 2*a*, 2*b*, 3*a*, 3*b* to be grooved, so that the material which is pulled into the grooves 4, 5 and 4', 5', during grooving must be pulled out from the inner material piece, which at any one time is between the grooving discs 8, 9 or 8', 9'. Proceeding in such a way has the advantage that both free running ends of each side of the sack, which later form the bottom inward-folding side panels, run parallel to each other and thereby result in flawless coverings.

With earlier grooving equipment, the side flaps were formed by arched fold lines, so that even when calculating the length of the material piece it had to be seen to that the areas which were pulled in the furthest by the grooving discs from the outside ends could also be covered with each other. This means that for safety reasons the inner material section always had to be longer than that which is needed with proper grooving. Therefore, grooving with the grooving device resulting from this invention saves in practice approximately 1 cm of sack material on each end. This means that a total of 6 cm of sack material can be saved when manufacturing three-ply sacks, for example.

I claim:

1. A device for grooving continuously-fed flat workpieces to form fold lines in bottom side panels, said device comprising:

two slotted discs having a common central axis, each slotted disc having a circumferential groove, two grooving discs, each grooving disc having a circular edge penetrating into a respective one of said circumferential grooves, and two clamp rollers, each clamp roller including a cylindrical disc having a radially outermost elastic material casing, an outer diameter of said elastic material casing in a non-compressed condition being equal to a diameter of said grooving disc, said elastic material casing compressively contacting a cylindrical section of a respective one of said slotted discs for preventing a free outer area of the workpiece from being pulled into said circumferential groove of said slotted disc while said circular edge of said grooving disc extends only partially into said circumferential groove, each said clamp roller including said cylindrical disc attached to said grooving disc with said cylindrical disc and said grooving disc rotating at a same rate of revolution, said two slotted discs being separated from each other along said central axis, a respective one of said two clamp rollers being located adjacent to each of said two slotted discs with said cylindrical disc of each clamp roller being located on only a laterally outward side of a respective one of said grooving discs for retaining an inner material piece of a flat workpiece between said grooving discs so as to form fold lines adjacent to outer edges of the flat workpiece while maintaining a position of side panels of said flat workpiece and preventing movement of said side panels into said circumferential grooves.

* * * * *